US006517391B1

(12) United States Patent
Chadbourne

(10) Patent No.: US 6,517,391 B1
(45) Date of Patent: Feb. 11, 2003

(54) INSULATION PIERCING WEDGE CONNECTOR

(75) Inventor: Richard Chadbourne, Merrimack, NH (US)

(73) Assignee: Framatome Connectors USA Inc., Fairfield, CT (US)

( * ) Notice: Subject to any disclaimer, the term of this patent is extended or adjusted under 35 U.S.C. 154(b) by 0 days.

(21) Appl. No.: 08/990,996

(22) Filed: Dec. 15, 1997

(51) Int. Cl.[7] ..... H01R 11/01
(52) U.S. Cl. ..... 439/783; 439/863
(58) Field of Search ..... 439/783, 417, 439/435, 393, 863

(56) References Cited

U.S. PATENT DOCUMENTS

| | | | | |
|---|---|---|---|---|
| 2,106,724 | A | 2/1938 | Cope | 173/273 |
| 2,814,025 | A | 11/1957 | Wade et al. | 39/256 |
| 2,828,147 | A | 3/1958 | Peiffer | 285/138 |
| 3,065,449 | A | 11/1962 | Matthysse et al. | 439/83 |
| 3,275,974 | A | 9/1966 | Mixon, Jr. | 439/83 |
| 3,329,928 | A | 7/1967 | Broske | 439/83 |
| 3,349,167 | A | 10/1967 | Mixon, Jr. et al. | 174/94 |
| 3,462,543 | A | 8/1969 | Wahl et al. | 174/94 |
| 3,504,332 | A | 3/1970 | Mixon, Jr. | 439/796 |
| 3,516,050 | A | 6/1970 | Mixon, Jr. et al. | 439/783 |
| 3,588,791 | A | 6/1971 | Polldori | 439/783 |
| 3,811,105 | A | 5/1974 | Gerhard | 339/98 |
| 3,920,310 | A | 11/1975 | Walsh et al. | 439/730 |
| 4,059,333 | A | 11/1977 | Mixon, Jr. | 439/783 |
| 4,070,082 | A | 1/1978 | Werner | 439/417 |
| 4,533,205 | A | 8/1985 | Frank | 439/783 |
| 4,600,264 | A | 7/1986 | Counsel | 439/783 |
| 4,634,205 | A | 1/1987 | Gemra | 439/391 |
| 4,650,273 | A | 3/1987 | Roosdrop | 439/783 |
| 4,723,920 | A | 2/1988 | Werner | 439/782 |
| 4,730,087 | A | 3/1988 | Werner | 174/94 S |
| 4,734,062 | A | 3/1988 | Goto | 439/783 |
| 4,813,894 | A | 3/1989 | Mixon, Jr. | 439/783 |
| 4,863,403 | A | 9/1989 | Shannon | 439/783 |
| 4,872,856 | A | 10/1989 | Pooley et al. | 439/783 |
| 4,915,653 | A | 4/1990 | Mair | 439/781 |
| 5,006,081 | A | 4/1991 | Counsel et al. | 439/783 |
| 5,044,996 | A | 9/1991 | Goto | 439/783 |
| 5,145,420 | A | 9/1992 | Counsel et al. | 439/783 |
| 5,244,422 | A | 9/1993 | Laricchia | 439/783 |
| 5,507,671 | A | 4/1996 | Chadbourne et al. | 439/783 |
| 5,538,447 | A | 7/1996 | Chadbourne et al. | 439/783 |
| 5,558,546 | A | 9/1996 | Chadbourne et al. | 439/783 |
| 5,613,883 | A | 3/1997 | Chadbourne et al. | 439/783 |
| 5,679,031 | A | 10/1997 | Chadbourne et al. | 439/783 |

FOREIGN PATENT DOCUMENTS

| | | |
|---|---|---|
| CA | 2070302 | 12/1992 |
| DE | 3824741 A1 | 1/1990 |
| EP | 0 653 802 A1 | 5/1995 |
| EP | 0810687 | 12/1997 |
| EP | 0810688 | 12/1997 |
| GB | 2 065 994 | 7/1981 |

*Primary Examiner*—Tulsidas Patel
(74) *Attorney, Agent, or Firm*—Perman & Green, LLP

(57) ABSTRACT

An electrical wedge connector with a wedge and a shell. The shell is a one-piece sheet metal member with a conductor piercing section. The conductor piercing section comprises a tab of the sheet metal member at an end of the shell that is folded about 180° inward against an interior side of the shell. The tab has a section that projects in an inward direction generally perpendicular to the interior side and has teeth at an end edge thereof.

20 Claims, 5 Drawing Sheets

INSULATION PIERCING WEDGE CONNECTOR

BACKGROUND OF THE INVENTION

1. Field of the Invention

The present invention relates to electrical connectors and, more particularly, to a wedge connector.

2. Prior Art

U.S. Pat. No. 5,679,031 discloses a wedge connector with a shell having retention barbs. The barbs are shown located at the curved walls of the shell and at the front and rear ends of the shell. The barbs can help mechanically retain the conductor in the wedge connector. However, such a connector is for use in connecting bare conductors to each other; i.e.: without electrical insulation or with the insulation removed before the wedge connector is attached. U.S. Pat. No. 3,811,105 discloses an electrical connector with a clamping unit having conductor biting teeth.

SUMMARY OF THE INVENTION

In accordance with one embodiment of the present invention, an electrical wedge connector is provided comprising a wedge and a shell. The shell is suitably sized and shaped to receive the wedge and a conductor in a receiving area with the conductor being sandwiched between the wedge and a curved wall of the shell. The curved wall has a conductor piercing section comprising a first portion which has been folded back onto an inner side of the curved wall and a second section that projects inward into the receiving area.

In accordance with another embodiment of the present invention, a wedge connector shell is provided comprising a one-piece sheet metal member forming a receiving area for a wedge and an electrical cable. The sheet metal member has an insulation piercing section extending inward into the receiving area which is sized and shaped to pierce through an electrical insulation cover of the cable and make direct electrical contact with an electrical conductor of the cable.

In accordance with one method of the present invention, a method of manufacturing a shell for an electrical wedge connector is provided comprising steps of forming a flat sheet metal member into a general C-shape; and bending a section of the sheet metal member back upon itself wherein the section has a first portion directly adjacent an interior side of the general C-shape and a second portion extending in an inward direction generally perpendicular to the first section.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENTS

Figure 1:
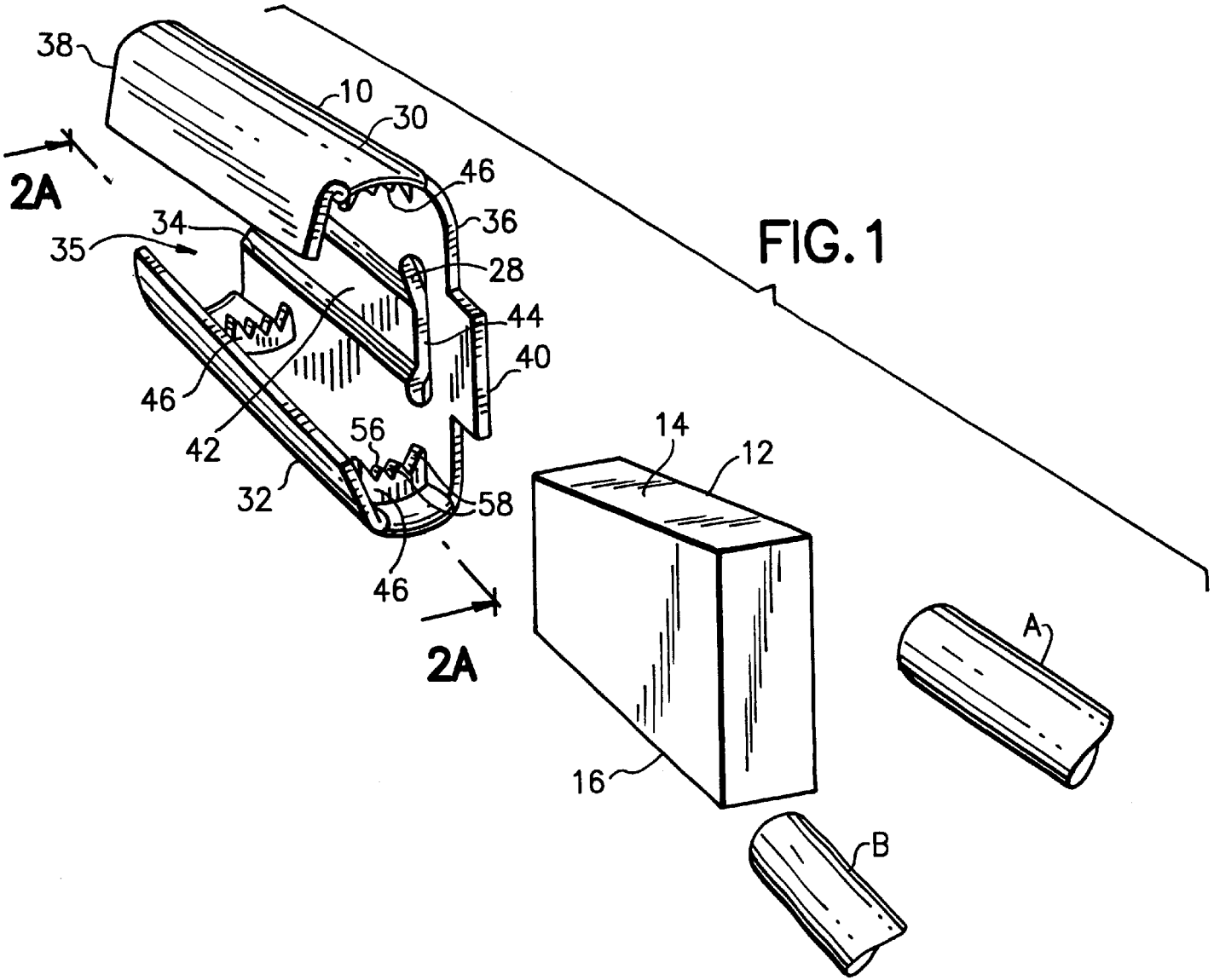
FIG. 1 is an exploded perspective view of a wedge connector incorporating features of the present invention with two electrical cables.

Referring to FIG. 1, there is shown an exploded perspective view of an electrical wedge connector incorporating features of the present invention and two electrical cables A, B. Although the present invention will be described with reference to the embodiments shown in the drawings, it should be understood that the present invention can be embodied in many alternate forms of embodiments. In addition, any suitable size, shape or type of elements or materials could be used.

The wedge connector comprises a shell 10 and a wedge 12. The wedge has two sides 14, 16 which are suitably sized and shaped to engage the conductors A, B to sandwich the conductors A, B against interior sides of the shell 10. The wedge 12 also has a latch (not shown) for engaging the shell at hole 28 to lock the wedge 12 in the shell. Various different types of wedges are known in the art such as disclosed in U.S. Pat. Nos. 5,507,671; 5,538,447; 5,558,546; and 5,613,883 which are hereby incorporated by reference in their entireties. However, in alternate embodiments, any suitable type of wedge could be used.

The shell 10 is a one-piece member that is preferably made of sheet metal, but it could also be a cast, drawn, or extruded member. The shell 10 has two opposing channel sections 30, 32 interconnected by a middle section 34 to form a general "C" shape with a receiving area 35 for receiving the wedge 12 and the cables A, B. The "C" shape tapers from the rear end 36 to the front and 38. The middle section 34 includes a rear end tab 40, a groove or depression 42, and the slot 28. The slot 28 is located proximate the rear end of the shell and forms a stop ledge 44. The slot 28 extends entirely through the middle section 34 from the interior surface to the exterior surface. However, in an alternate embodiment that slot 28 need not extend entirely through the middle section 34. The depression 42 extends from the slot 28 to the front end 38 of the shell 10. In another alternate embodiment, the depression 42 need not be provided or need not extend to the front end 38, but if provided the slot 28 should be located at the rear end of the depression 42.

Figure 2A:
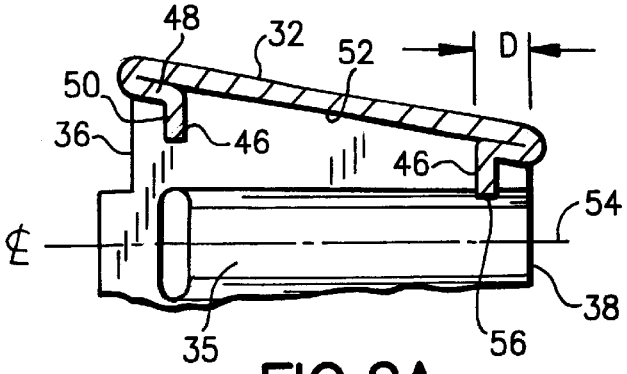
FIG. 2A is a partial cross-sectional view of the shell shown in FIG. 1.

Referring also to FIG. 2A, a partial cross-sectional view of the shell 10 is shown. The shell 10 includes four insulation piercing sections 46. Two of the piercing sections 46 are provided at the first channel section 30 proximate the front and rear ends 38, 36 of the shell and two of the piercing sections 46 are provided at the second channel section 32 proximate the front and rear ends 38, 36 of the shell. In alternate embodiments more or less than four piercing sections could be provided and they need not be provided proximate the front and rear ends of the shell. The piercing sections could also extend from the middle section 34. In the embodiment shown, each piercing section 46 has a first portion 48 and a second portion 50, The first portion 48 comprises a portion of the one-piece sheet metal member that is folder or bent about 180° back around and against the interior side 52 of the shell. In an alternate embodiment the first portion 48 may be slightly spaced from the interior side 52. The second portion 50 extends from the interior side 52 generally perpendicular to the centerline axis 54 of the receiving area 35. In an alternate embodiment, the second portion 50 could extend at an angle relative to the centerline axis 54, such as generally perpendicular to the interior side 52 at the channel sections 30, 32. In the embodiment shown, the end edge 56 of the second portion 50 has teeth 58. In alternate embodiments teeth need not be provided, such as if the edge 56 has a sharp angled blade edge. As used herein, the term "insulation piercing section" is intended to mean a section that is intentionally specifically configured to pierce through an outer insulation covering of an electrical cable and make an intended electrical connection with an electrical conductor section of the cable located inside the insulation covering.

Figure 2B:
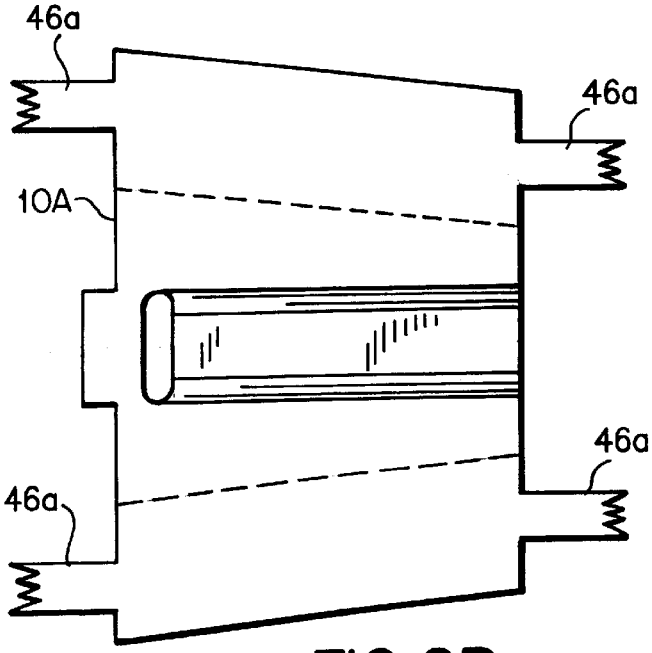
FIG. 2B is a top plan view of a shell blank used to form the shell shown in FIG. 1.
Figure 2C:
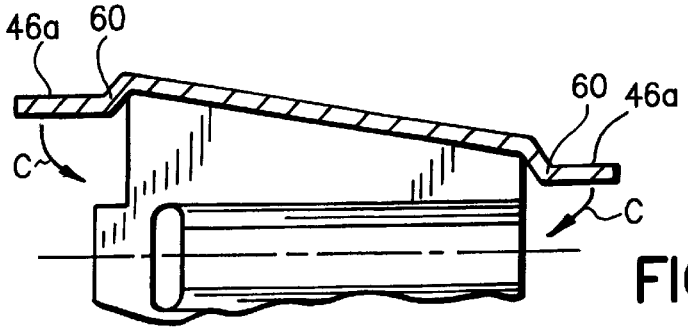
FIG. 2C is a partial cross-sectional view of the shell blank shown in FIG. 2B partially deformed as it is being made into the shape shown in FIG. 2A.

Referring also to FIG. 2B, the shell 1 is first provided as a flat sheet metal blank 10A with four tabs or extensions 46*a*. Referring also to FIG. 2C, the tabs 46*a* are first stamped to form a bend 60. The bend 60 forms the junction between the first and second portions 48,50 of each piercing sections 46. Then the tabs 46*a* are further deformed as indicated by arrows C to bend the tabs inward behind the front and rear ends 38, 36 into the position shown in FIG. 2A. The deformation of the tabs 46*a* into the piercing sections 46 can occur either before or after the curved sections 30, 32 are formed. This offsets the teeth 58 behind the two ends 36, 38 and allows the teeth 58 to be recessed inside the channel sections 30, 32. The distance D of recess from the ends 36 or 38 could be selected at any suitable distance. In an alternative embodiment, there need not be a recess behind the ends 36, 38. Thus, the distance D could be zero. In the embodiment shown, each piercing section has its second portion 50 in a single plane generally transverse to the center axis of the shell and transverse to the path of insertion of the wedge.

In the embodiment shown, because the piercing sections 46 are made from the tabs 46*a,* and because the tabs 46*a* are part of the flat sheet metal member 10*a,* the resulting piercing sections 46 have a wall thickness that is the same as the wall thickness of the rest of the shell. However, in an alternate embodiment, the end edge 56 could be stamped or cut at on an angle to form the teeth with sharp angled blade edges. In the embodiment shown the teeth 58 at each piercing section 46 are provided as multiple separate cutting blades and, in particular, relatively flat saw tooth shaped teeth. This saw teeth configuration provides an advantage during manufacturing. In particular, because of the curvature of the two channel sections 30, 32, the gaps between the individual teeth allow the second portion 50 to extend inward without buckling. In other words, the gaps compensate and accommodate for the curved nature of the channel sections 30, 32 and the fact that the second portions 50 extend from the interior sides of the channel sections 30, 32. In alternate embodiments other shaped piercing sections could be provided including different shaped teeth. The method of manufacture preferably comprises forming the U-shaped curvature of the channel sections 30, 32 after the tabs are bent back against their intended interior sides. This may include use of a collapsible mandrel in the forming process. A wiping step preferably finishes final positioning of the teeth after the U-shaped curvatures of the channel sections 30, 32 are formed.

The present invention allows the wedge connector to be used with insulated electrical cables without having to remove portions of the insulation prior to connection with the wedge connector. More specifically, the piercing section 46 is adapted to pierce through the cable insulation and into the electrical conductors under the insulation to thereby electrically connect the two cables A, B to each other through the shell 10. Preferably, after connection, an electrically insulating encapsulating cover is then installed over the wedge connector. One of the advantages of the present invention is that the length of the second portions 50 can easily be varied during manufacture for different size cables and different thicknesses and insulation. Another advantage is that, because the two piercing sections 46 on one channel section 30 or 32 are spaced apart, contact can be made with substantially all conductor strands inside a cable for a better electrical connection. Another advantage is that preexisting encapsulating covers can still be used with the present invention because the outer profile and size of the wedge connector can be the same as prior art wedge connectors. Another advantage is that the wedge 12 need not pierce through the cable insulation. This allows the wedge to more freely slide into its final position with less force than would be needed if the wedge needed to pierce through the insulation.

Figure 3:
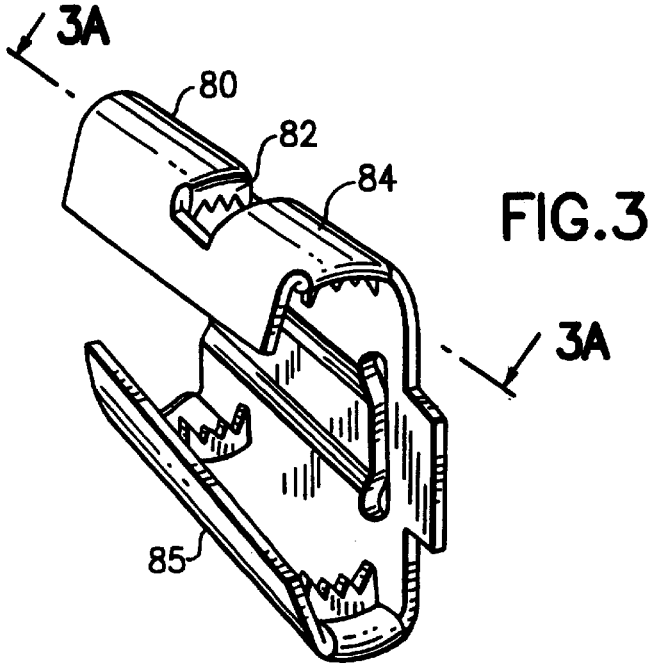
FIG. 3 is a perspective view of an alternate embodiment of the invention.
Figure 3A:
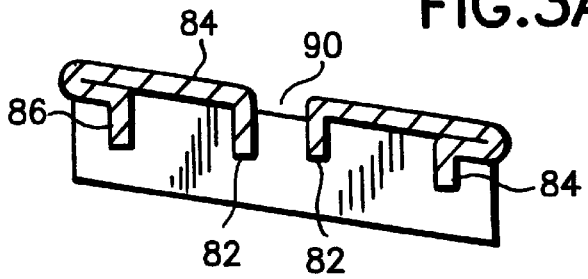
FIG. 3A is a partial cross-sectional view of the shell shown in FIG. 3.

Referring now to FIG. 3, an alternate embodiment of the wedge connector shell is shown. In this embodiment the shell 80 is substantially similar to the shell 10 shown in FIG. 1, but includes addition intermediate insulation piercing sections 82. Referring also to FIG. 3A, in addition to the top channel section 84 having a front insulation piercing section 86 and a rear insulation piercing section 88, the top channel section 84 has a hole 90 therethrough.

Figure 3B:
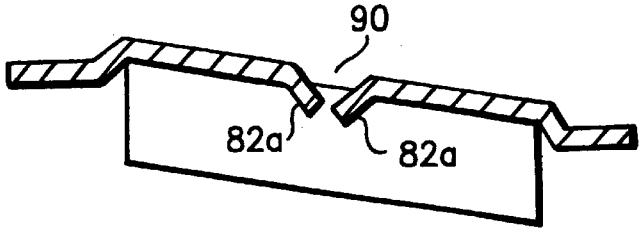
FIG. 3B is a partial cross-sectional view of the shell being formed into the shape shown in FIG. 3A.

In this embodiment the two intermediate sections 82 are located at a front end and at a rear end of the hole 90. The sections 82 have insulation piercing teeth and extend generally perpendicular to the centerline axis of the shell 80. Referring also to FIG. 3B the sections 82 are formed by cutting or stamping through the channel section wall to form sections 82*a* and then deforming the sections 82*a* inward. This provides additional insulation piercing teeth along the length of the shell. This allows or insures that conductor strands of a cable are contacted. Spacing apart the piercing sections results in all or substantially all of the strands being contacted (due to the helical wrapping of the strands in a cable). Contacting all strands or many strands can be important for good electrical performance of the connection. The length of the shell can be selected to properly space the sections 82, 86, 88 to allow all the strands to be contacted by piercing through a single side of the cable. This allows the wedge to slide more freely against the cables without also requiring the wedge to pierce the cable to help contact all of the strands. Of course, a piercing wedge could be used if desired. In a preferred embodiment both the top and bottom channel sections 84, 85 have the intermediate piercing sections.

Figure 4:
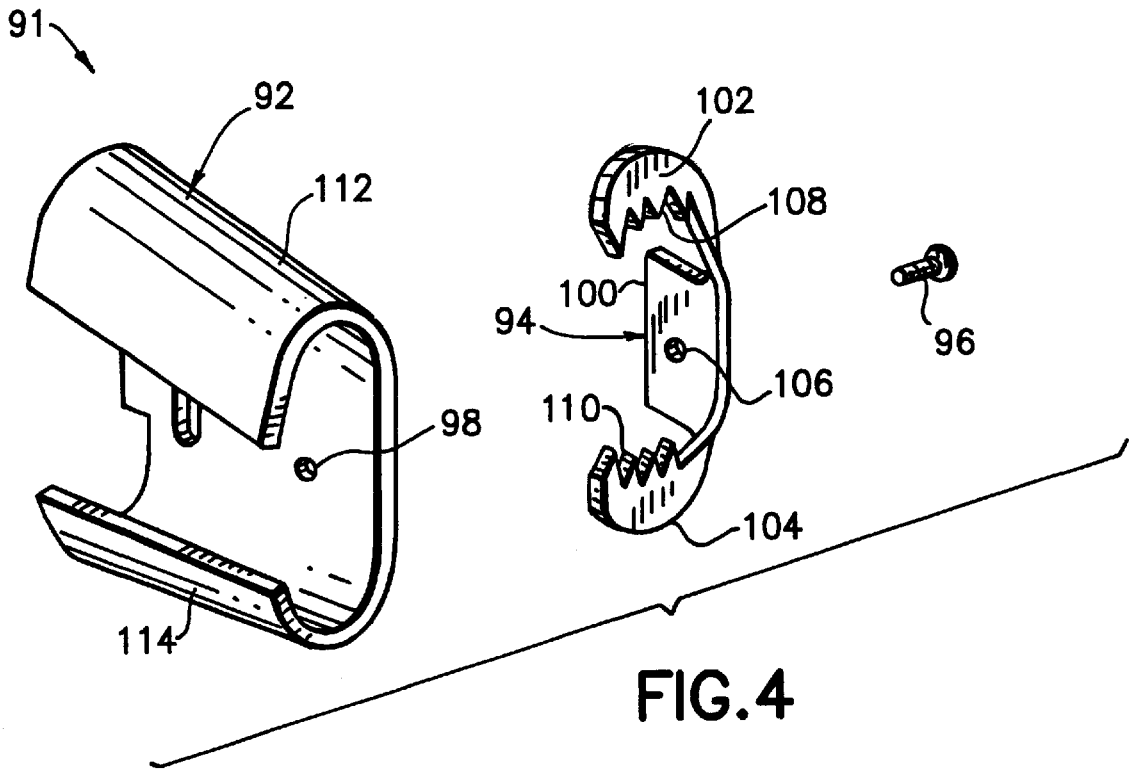
FIG. 4 is an exploded perspective view of another alternate embodiment of the wedge connector shell.

Referring now to FIG. 4, an exploded perspective view of another alternate embodiment of the wedge connector shell is shown. In this embodiment, the shell 91 includes a shell section 92, an insert 94 and a fastener 96. The shell section 92 is substantially identical to a prior art wedge connector shell with one exception. The shell section 92 includes a hole 98 for the fastener 96. The insert 94 comprises a one-piece sheet metal member with a mounting section 100, a top insulation piercing section 102 and a bottom insulation piercing section 104. The mounting section 100 has a hole 106 for the fastener 96.

The piercing sections 102, 104 have insulation piercing teeth 108, 110 similar to those seen in the embodiments of FIGS. 1 and 3. The insert 94 is sized and shaped to be received inside the shell section 92 with the piercing sections 104 located against the interior sides of the channel sections 112, 114. In an alternate embodiment the shell section 92 could have a specific seat for the insert 94. The two holes 98, 106 are aligned and the fastener 96 is inserted. In this embodiment the fastener is a rivet. However, any suitable fastener or fasting system could be used. Other types of inserts could also be used.

Figure 5A:
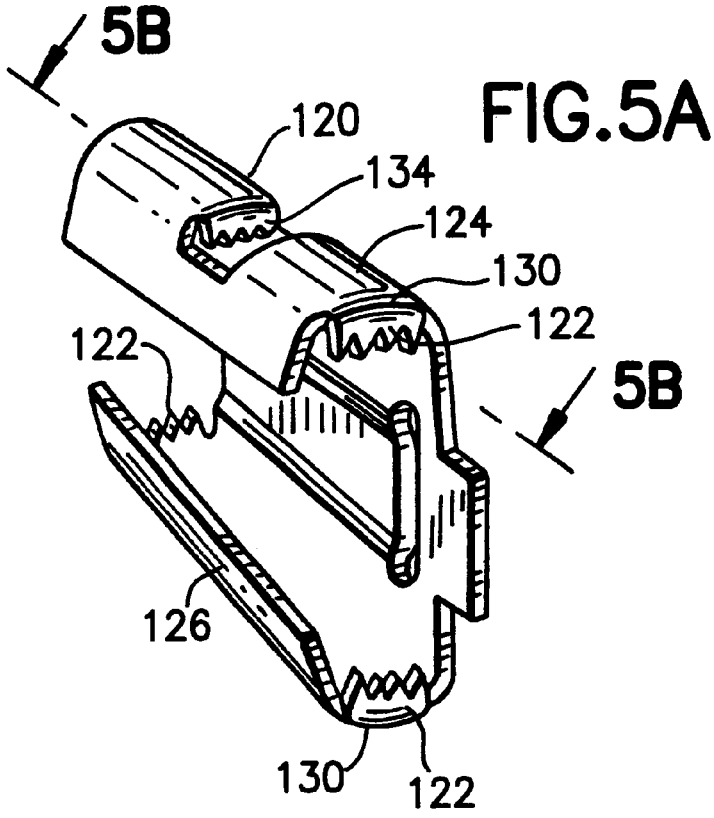
FIG. 5A is a perspective view of another alternate embodiment of the shell.
Figure 5B:
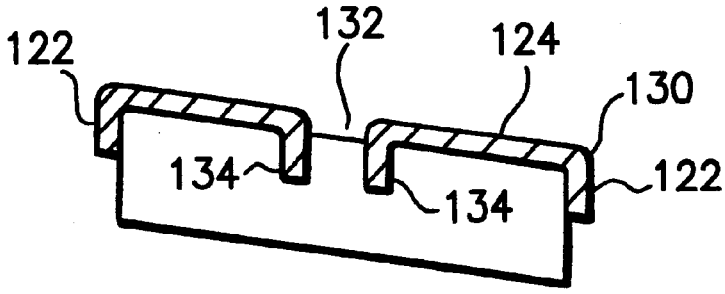
FIG. 5B is a cross-sectional view of the shell of FIG. 5A taken along line 5B—5B.

Referring to FIGS. 5A and 5B, another alternate embodiment is shown. In this embodiment the shell 120 is substantially similar to the shell 80 shown in FIG. 3. However, in this embodiment the front and rear piercing sections 122 extend inward from their respective channel sections 124, 126 at the outer ends of the shell 120 rather than being recessed inside the channel sections 124, 126. The piercing sections 122 have saw teeth 128 which accommodate the curved bases 130 where the piercing sections 122 extend from. The top channel section 124 also includes the hole 132 and two intermediate piercing sections 134.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical wedge connector comprising:

a wedge; and a shell suitably sized and shaped to receive the wedge and a conductor in a receiving area with the conductor being sandwiched between the wedge and a curved wall of the shell, the curved wall having an insulation piercing section comprising a first portion which has been folded back onto an inner side of the curved wall and a second section that projects inward into the receiving area.

2. A connector as in claim 1 wherein the shell is comprised of a one-piece sheet metal member.

3. A connector as in claim 1 wherein the insulation piercing section is folded back onto the inner side of the curved wall at a rear end of the curved wall.

4. A connector as in claim 1 wherein the insulation piercing section is folded back onto the inner side of the curved wall at a front end of the curved wall.

5. A connector as in claim 4 wherein the shell comprises at least two insulation piercing sections, a first one of the sections being folded back at the front end of the curved wall and a second one of the sections being folded back at a rear end of the curved wall.

6. A connector as in claim 5 wherein the shell has a general C-shape with two of the curved walls, each of the curved walls having two of the insulation piercing sections.

7. A connector as in claim 1 wherein the shell has a general C-shape and the insulation section comprises a cantilevered insulation piercing tab extending from an end of the general C-shape that is bent back about 180°.

8. A connector as in claim 1 further comprising another insulation piercing section formed at a middle portion of the curved wall comprising a section of the curved wall being cut and inwardly deformed thereby forming an aperture in the curved wall.

9. A connector as in claim 8 wherein, for use with a multi-strand conductor, the insulation piercing sections are sized and spaced relative to each other to contact substantially all strands in the multi-strand conductor when operably attached thereto.

10. A connector as in claim 1 wherein the insulation piercing section has multiple teeth at an edge extending inward into the receiving area.

11. In a wedge connector shell, the shell comprising a one-piece sheet metal member forming a receiving area for a wedge and an electrical cable, wherein the improvement comprises:

the metal member having an insulation piercing section extending inward into the receiving area which is sized and shaped to pierce through an electrical insulation cover of the cable and make direct electrical contact with an electrical conductor of the cable, wherein the insulation piercing section comprises a tab of the sheet metal member which is folded to project inward generally perpendicular to a centerline axis of the shell, wherein the tab has teeth at a free end thereof.

12. In a wedge connector shell, the shell comprising a one-piece sheet metal member forming a receiving area for a wedge and an electrical cable, wherein the improvement comprises:

the metal member having an insulation piercing section extending inward into the receiving area which is sized and shaped to pierce through an electrical insulation cover of the cable and make direct electrical contact with an electrical conductor of the cable, wherein the insulation piercing section comprises a flap of the sheet metal member that is folded about 180° into a receiving area of the shell.

13. A shell as in claim 11 wherein a flap extends from an end of the sheet metal member.

14. A shell as in claim 11 wherein the insulation piercing section has a first portion folded against an interior side of the shell and a second portion extending generally perpendicularly from the first portion into the receiving area.

15. A shell as in claim 11 wherein the shell has multiple spaced apart insulation piercing sections.

16. A shell as in claim 15 wherein the insulation piercing sections include tabs at front and rear ends of the shell that are folded back against an interior side of the shell.

17. A shell as in claim 11 wherein an end edge of the tab has multiple teeth.

18. A method of manufacturing a shell for an electrical wedge connector, the method comprising steps of:

forming a flat sheet metal member into a general C-shape; and bending a section of the sheet metal member back upon itself wherein the section has a first portion directly adjacent an interior side of the general C-shape and a second portion extending in an inward direction generally perpendicular to a centerline axis of the C-shape.

19. An electrical wedge connector for receiving at least one insulated electrical cable and making electrical connection therewith, the cable having an inner electrical conductor section and an outer electrical insulation section, the wedge connector comprising:

a wedge; and a shell having a receiving area suitably sized and shaped to receive the wedge and the cable therein with the cable being sandwiched between the wedge and a curved wall of the shell, the curved wall having at least one insulation piercing section, each insulation piercing section extending transverse to a path of insertion of the wedge into the shell and comprising a tab extending inwardly from the curved wall, the tab comprising a set of multiple piercers protruding inwardly, wherein each set of piercers extends from the curved wall in a row transverse to the path of insertion of the wedge into the shell.

20. A connector as in claim 19 wherein, for each set of piercers, the piercers have leading edges distributed on a general semi-circular path.

* * * * *